US009098041B2

(12) United States Patent
Suzuki

(10) Patent No.: US 9,098,041 B2
(45) Date of Patent: Aug. 4, 2015

(54) IMAGE FORMING APPARATUS FOR DETECTING PATCH IMAGE INCLUDING A PLURALITY OF REGIONS

(71) Applicant: CANON KABUSHIKI KAISHA, Tokyo (JP)

(72) Inventor: Shinya Suzuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/710,852

(22) Filed: Dec. 11, 2012

(65) Prior Publication Data

US 2013/0164006 A1 Jun. 27, 2013

(30) Foreign Application Priority Data

Dec. 27, 2011 (JP) ..... 2011-286621

(51) Int. Cl.
*G03G 15/00* (2006.01)
*G03G 15/01* (2006.01)

(52) U.S. Cl.
CPC ..... *G03G 15/5025* (2013.01); *G03G 15/0189* (2013.01); *G03G 15/5058* (2013.01); *G03G 2215/0161* (2013.01)

(58) Field of Classification Search
CPC ..... G03G 15/5058; G03G 15/5025
See application file for complete search history.

(56) References Cited

U.S. PATENT DOCUMENTS 5,867,755 A * 2/1999 Sato ..... 399/149
6,218,660 B1 4/2001 Hada
6,640,077 B2 10/2003 Suzuki et al.
7,206,531 B2 4/2007 Suzuki et al.
7,209,673 B2 4/2007 Suzuki et al.
7,489,884 B2 2/2009 Ichikawa et al.
8,036,552 B2 * 10/2011 Hashimoto ..... 399/49
2007/0116482 A1 * 5/2007 Ichikawa et al. ..... 399/49
2007/0127937 A1 * 6/2007 Ichikawa et al. ..... 399/49

(Continued)

FOREIGN PATENT DOCUMENTS

CN 101403872 A 4/2009
JP 4-238367 A 8/1992

(Continued)

OTHER PUBLICATIONS

UK Combined Search and Examination Report dated Apr. 29, 2013, in UK Application No. GB 1223002.5.

(Continued)

*Primary Examiner* — Walter L Lindsay, Jr.
*Assistant Examiner* — Arlene Heredia Ocasio
(74) *Attorney, Agent, or Firm* — Fitzpatrick, Cella, Harper & Scinto

(57) ABSTRACT

An image forming apparatus includes a plurality of developing units configured to develop latent images formed on a plurality of photosensitive members by exposure units; an image carrier, on which the developed images formed on the plurality of photosensitive members are transferred; a sensor configured to irradiate the image carrier with light, and detect an amount of reflected light; and a patch detection unit configured to detect a position of a patch image, formed on the image carrier, based on the amount of reflected light detected by the sensor. The patch image has a first region and a second region formed on the same photosensitive member, the second region is formed to be adjacent to the first region, and a density of the second region is lower than that of the first region.

12 Claims, 14 Drawing Sheets

(56) References Cited

U.S. PATENT DOCUMENTS

| | | | | |
|---|---|---|---|---|
| 2007/0134013 | A1 | 6/2007 | Soya et al. | |
| 2008/0253781 | A1* | 10/2008 | Takezawa | 399/39 |
| 2009/0162084 | A1 | 6/2009 | Itagaki | |
| 2010/0054775 | A1* | 3/2010 | Nakase | 399/49 |
| 2010/0245921 | A1* | 9/2010 | Kikuchi et al. | 358/1.18 |
| 2010/0266302 | A1* | 10/2010 | Suzuki et al. | 399/49 |
| 2011/0052229 | A1 | 3/2011 | Shishikura et al. | |
| 2011/0243589 | A1* | 10/2011 | Katayama | 399/49 |
| 2011/0280605 | A1* | 11/2011 | Kishi | 399/49 |

FOREIGN PATENT DOCUMENTS

| | | | |
|---|---|---|---|
| JP | 10-260567 | A | 9/1998 |
| JP | 11-295037 | A | 10/1999 |
| JP | 2004-38013 | A | 2/2004 |
| JP | 2007-78778 | A | 3/2007 |
| JP | 2007-140402 | A | 6/2007 |
| JP | 2008-58821 | A | 3/2008 |
| JP | 2010-048904 | A | 3/2010 |
| JP | 2010-256638 | A | 11/2010 |

OTHER PUBLICATIONS

Office Action issued in UK Patent Application No. GB1223002.5, dated Oct. 3, 2014.

Office Action in Chinese Patent Application No. 201210578385.0, dated Dec. 1, 2014.

Office Action dated Oct. 15, 2013, in Japanese Application No. 2011-286621.

* cited by examiner

IMAGE FORMING APPARATUS FOR DETECTING PATCH IMAGE INCLUDING A PLURALITY OF REGIONS

BACKGROUND OF THE INVENTION

1. Field of the Invention

The present invention relates to a control of a position where an image, and in particular a toner image, is formed.

2. Description of the Related Art

Conventionally, an image forming apparatus for irradiating a plurality of photosensitive members with a laser beam to form an electrostatic latent image on each photosensitive member, developing each electrostatic latent image by toner of each color, and transferring and superimposing a plurality of toner images on a printing material or the like to form a color image has been used. In this type of image forming apparatus, due to a mechanical arrangement error of each photosensitive member, an error in light path length of a laser beam, or a change in light path length of a laser beam, a position of a printing material where each toner image is transferred may shift, thereby causing color misregistration. To deal with this problem, such an image forming apparatus forms a patch image for detecting color misregistration; that is, misregistration of toner images with respect to a reference color toner image, calculates an amount of the color misregistration, and executes color registration adjustment.

In a color registration adjustment control operation, a patch image is irradiated with light, and an optical sensor detects reflected light to detect the position of the patch image. More specifically, the position of the patch image is detected based on the timing when the light amount of the reflected light becomes larger or smaller than a predetermined threshold. If, therefore, the density of the patch image changes, the detected position of the patch image may become different even though the patch image is at the same position. Referring to FIG. 16, a solid line represents a change in amount of reflected light with time when a high-density patch image is irradiated with light, and a dotted line represents a change in amount of reflected light with time when a low-density patch image is irradiated with light. In FIG. 16, the difference between the densities of the patch images results in a difference Ta1 in the timing when the amount of the reflected light exceeds a threshold. The detected positions of the patch images are also different from each other.

Japanese Patent Laid-Open Nos. 10-260567 and 2010-048904 disclose a technique of stabilizing the density of a position detection patch image by forming a density control patch image before forming the position detection patch image in order to enable stable position detection.

The density is known to be high in the edge portion of a toner image in an image forming apparatus. This phenomenon in which the density is high in the edge of a toner image will be referred to as an edge density variation phenomenon hereinafter. The edge density variation phenomenon varies depending on degradation of a developer, development conditions such as a toner density, and latent image conditions such as a development contrast potential. It is, therefore, generally difficult to control an image forming apparatus so as not to cause the edge density variation phenomenon.

SUMMARY OF THE INVENTION

The present invention decreases the occurrence of the edge density variation phenomenon in the edge portion of a patch image, thereby enabling the detection of the position of the patch image with high accuracy.

According to a first aspect of the present invention, an image forming apparatus includes: a plurality of photosensitive members; a plurality of exposure units each arranged to expose a photosensitive member; a plurality of developing units configured to develop latent images formed on the plurality of photosensitive members by the exposure units; an image carrier, on which the developed images formed on the plurality of photosensitive members are transferred; a sensor configured to irradiate the image carrier with light, and detect an amount of reflected light; a patch detection unit configured to detect a position of a patch image, formed on the image carrier, based on the amount of reflected light detected by the sensor. The patch image has a first region and a second region formed on the same photosensitive member, the second region is formed to be adjacent to the first region, and a density of the second region is lower than that of the first region.

Further features of the present invention will become apparent from the following description of exemplary embodiments, with reference to the attached drawings.

DESCRIPTION OF THE EMBODIMENTS

Embodiments of the present invention will be described in detail below. Note that components which are not necessary for understanding the present invention are omitted from the accompanying drawings to be used in the following description for the sake of simplicity.

First Embodiment

Figure 1:
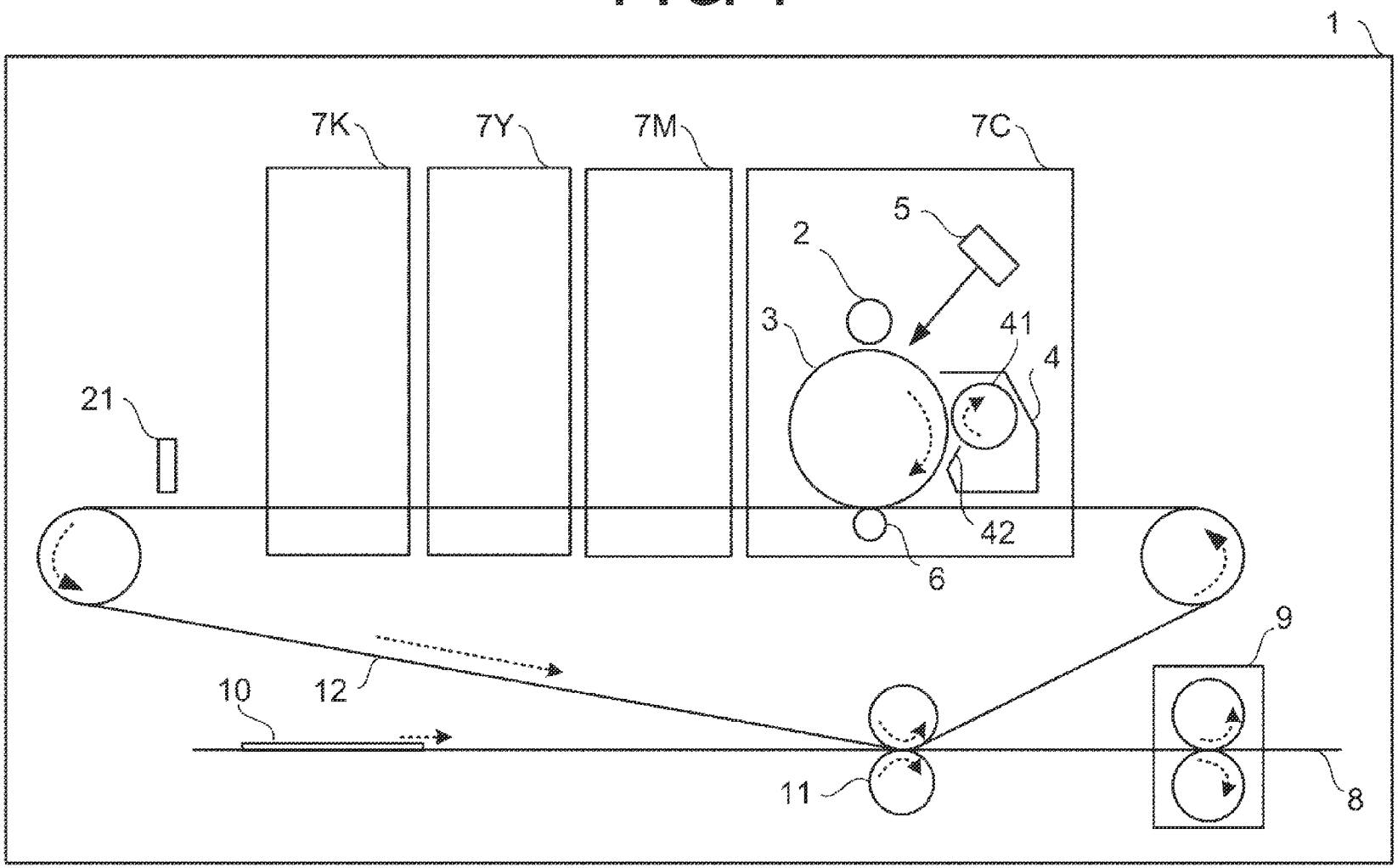
FIG. 1 is a view showing the arrangement of the image forming unit of an image forming apparatus according to an embodiment.

FIG. 1 is a view showing the arrangement of an image forming unit 1 of an image forming apparatus according to the embodiment. Note that in FIG. 1, each dotted arrow represents the moving direction or rotation direction of each member. Image forming stations 7C, 7M, 7Y, and 7K form cyan, magenta, yellow, and black toner images respectively, and transfer them on an image carrier; that is, an intermediate transfer belt 12 in this example. Note that the arrangements of the image forming stations 7C, 7M, 7Y, and 7K are the same except for toner colors, and only the image forming station 7C will be described below. A photosensitive member 3 serving as an image carrier is charged by a charging device 2, and an exposure device 5 scans the surface of the photosensitive member 3 with a laser beam based on image data indicating an image to be formed, and forms an electrostatic latent image.

A developing device 4 has a developer including toner of a corresponding color, and develops, with the toner, the electrostatic latent image formed on the photosensitive member 3 to form a toner image on the photosensitive member 3. Note that in this embodiment, the developer is a two-component developer obtained by mixing nonmagnetic toner with a corresponding color and magnetic carrier in a predetermined ratio. Note also that the developing device 4 includes a nonmagnetic developing sleeve 41 with a fixed magnet. The developing sleeve 41 is arranged to face the photosensitive member 3 at a closest distance (to keep an S-D gap) while part of the outer peripheral surface is exposed outside the developing device 4. A voltage device (not shown) applies a voltage to the developing sleeve 41. Note that a portion where the photosensitive member 3 faces the developing sleeve 41 will be referred to as a development region hereinafter. In this embodiment, the developing sleeve 41 is rotated and driven in the same direction as the rotation direction of the photosensitive member 3. In this case, a regulation blade 42 is arranged upstream of the development region in the rotation direction, and coats the surface of the developing sleeve 41 with the two-component developer to form a thin layer.

A primary transfer device 6 transfers the toner image formed on the photosensitive member 3 to the intermediate transfer belt 12. Note that the photosensitive member 3 and the intermediate transfer belt 12 move in the same direction at the position where the toner image is transferred from the photosensitive member 3, as shown in FIG. 1. Toner images formed by the image forming stations 7C, 7M, 7Y, and 7K are transferred to the intermediate transfer belt 12, and superimposed on one another, thereby forming a color image. The toner images on the intermediate transfer belt 12 are transferred, by a secondary transfer device 11, to a printing material 10 which is conveyed through a conveyance path 8, and a fixing device 9 fixes the toner images transferred to the printing material 10 by heat and pressure.

Figure 2:
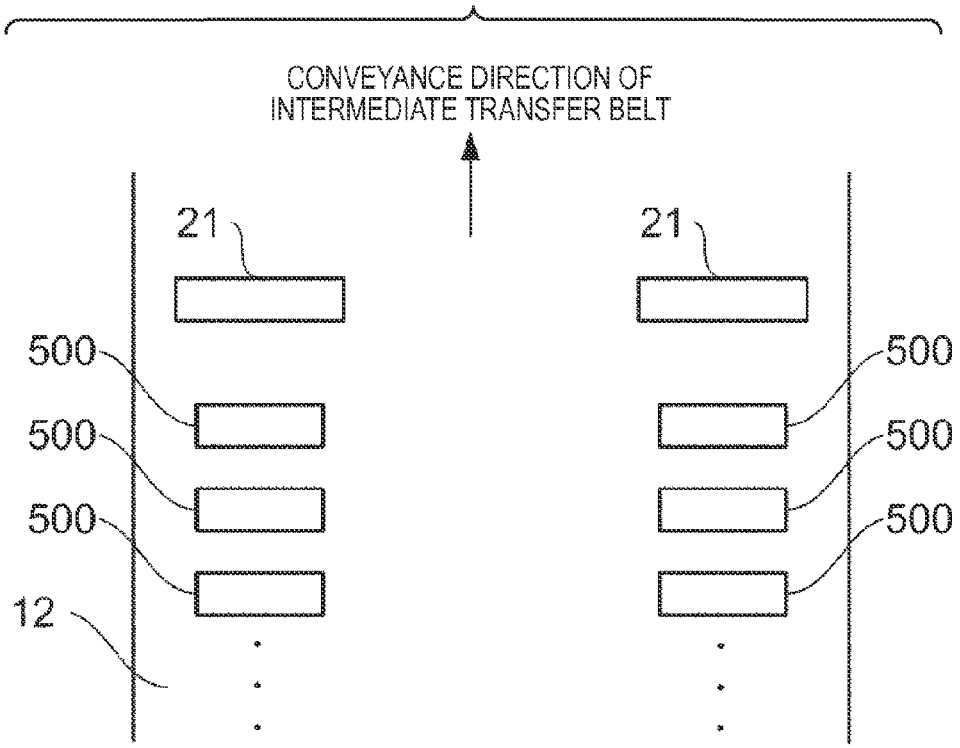
FIG. 2 is a view showing the arrangement of optical sensors.
Figure 3:
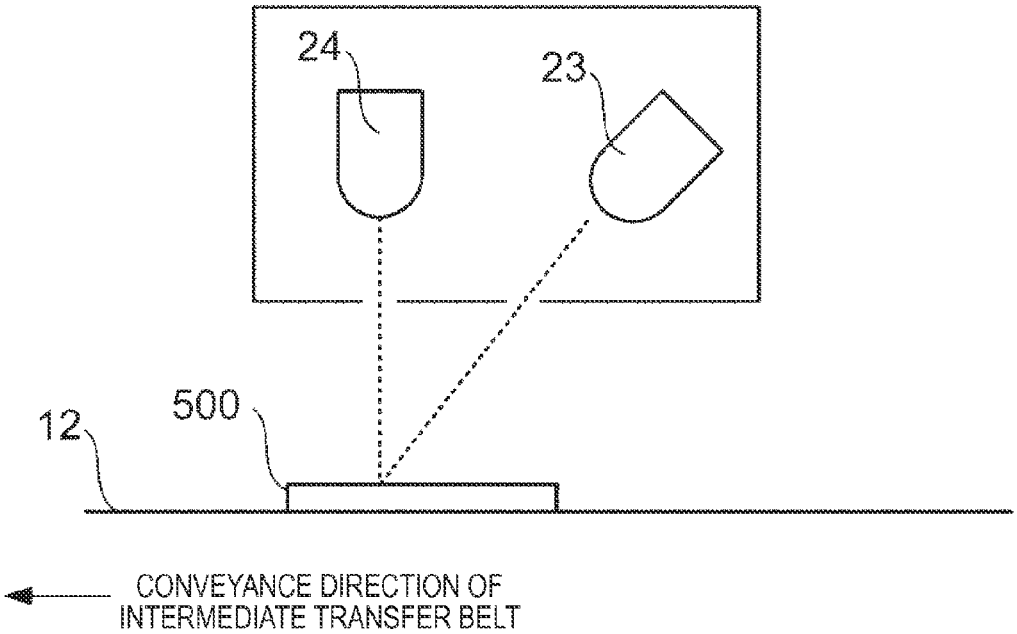
FIG. 3 is a view showing the configuration of the optical sensor.

Furthermore, an optical sensor 21 is arranged to face the intermediate transfer belt 12 downstream of the image forming station 7K in the conveyance direction of the intermediate transfer belt 12. The optical sensor 21 serves as a patch detection unit for detecting a position detection patch image to be used for color registration adjustment control, and a density control patch image. As shown in FIG. 2, the optical sensor 21 is arranged near each edge portion of the intermediate transfer belt 12 to detect patch images 500 formed near the edge portion. FIG. 3 is a view showing the configuration of the optical sensor 21. The optical sensor 21 includes a light-emitting element 23 such as an LED, and a light-receiving element 24 such as a photodiode or CdS. Note that the light-receiving element 24 is arranged at a position where it receives diffuse reflection light from a measurement target but does not receive specular reflection light from the measurement target. In the example of FIG. 3, the light-emitting element 23 is arranged so as to emit a laser beam at an angle of 45° with respect to the normal to the intermediate transfer belt 12, and the light-receiving element 24 is arranged so as to receive the laser beam reflected in the direction of the normal to the intermediate transfer belt 12. If the patch image 500 is formed on the intermediate transfer belt 12, the light emitted by the light-emitting element 23 is reflected by the patch image 500. Diffuse reflection light, among reflected light, which has reached the light-receiving element 24 is converted into an electric signal, and the light-receiving element 24 outputs a signal with an amplitude corresponding to the amount of the received light.

Figure 4:
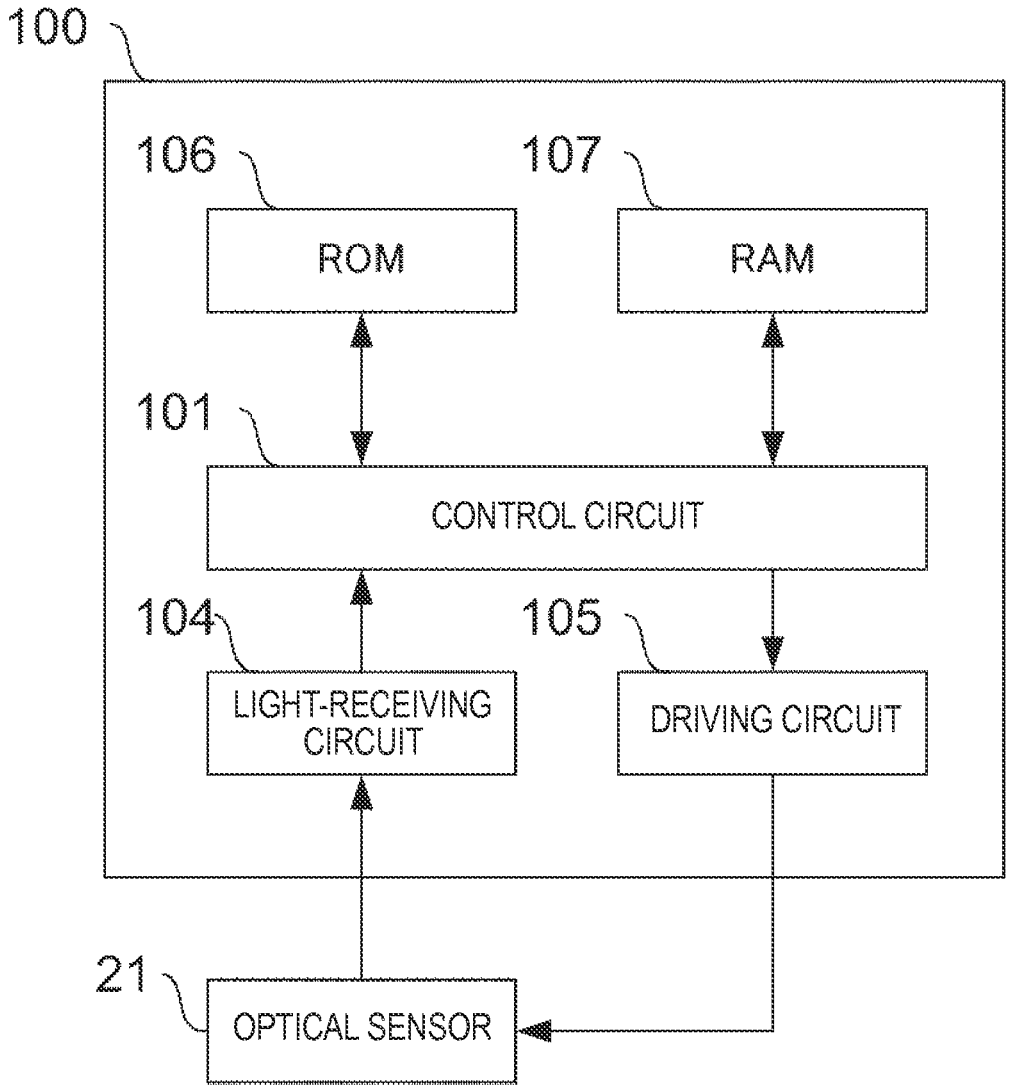
FIG. 4 is a block diagram showing the schematic arrangement of the control unit of the image forming apparatus according to an embodiment.

FIG. 4 is a block diagram showing the schematic arrangement of a control unit 100 of the image forming apparatus according to the present embodiment. Note that FIG. 4 shows only a portion associated with control of the optical sensor 21. A control circuit 101 controls the image forming unit 1 or the like based on control software or the like stored in a ROM 106. A RAM 107 is used to store various data and the like. A driving circuit 105 drives the light-emitting element 23 of the optical sensor 21 under the control of the control circuit 101. A light-receiving circuit 104 converts, into a voltage, an electric current corresponding to the amount of the received light output from the light-receiving element 24 of the optical sensor 21, and outputs it to the control circuit 101.

Figure 5A:
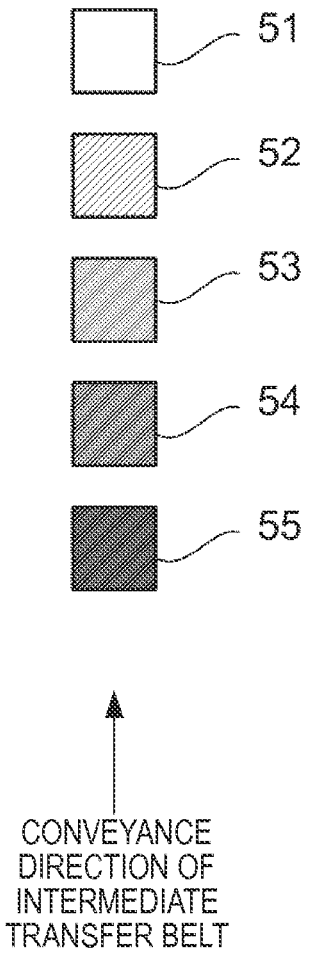
FIGS. 5A and 5B are views each showing an exemplary patch image.

In a density control operation, the control unit 100 forms, for each color, patch images 51 to 55 each having a certain tone, as shown in FIG. 5A. Note that data of the patch images have been stored in the ROM 106 or RAM 107. The patch images 51 to 55 with different densities are formed at a regular interval in the conveyance direction of the intermediate transfer belt 12, that is, the sub-scanning direction. As shown in FIG. 3, in the present embodiment, since the optical sensor 21 is provided at each edge of the intermediate transfer belt 12, a plurality of patch images for two of the four colors are formed on one side, and a plurality of patch images for the remaining two colors are formed on the other side. Note that although five patch images with different densities are formed for each color, the number of density levels is merely an example.

Figure 5B:
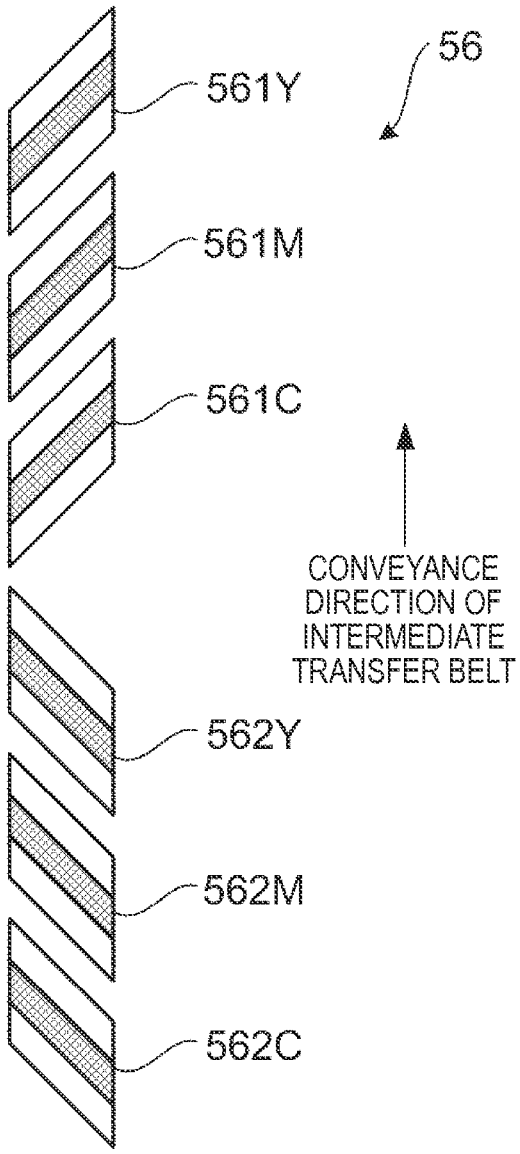

To perform a color registration adjustment control operation, that is, an adjustment control operation for the position of each toner image, for example, as shown in FIG. 5B, parallelogram-shaped patch images 561Y, 561M, 561C, 562Y, 562M, and 562C for the respective colors except for black as a reference color are arranged in the sub-scanning direction. Note that these six patch images are formed at each edge of the intermediate transfer belt 12. Note that the patch images 561Y and 562Y for yellow are used to detect misregistration of a yellow toner image with reference to a black toner image. Similarly, the patch images 561M and 562M are used to detect misregistration of a magenta toner image with reference to the black toner image, and the patch images 561C and 562C are used to detect misregistration of a cyan toner image with reference to the black toner image. At this time, as shown in FIG. 5B, the patch images 561Y, 561M, and 561C are created to tilt by a predetermined angle with respect to the main scanning direction perpendicular to the sub-scanning direction. Furthermore, the patch images 562Y, 562M, and 562C are formed to be symmetrical to the patch images 561Y, 561M, and 561C with respect to a line in the main scanning direction.

Note that since the six patch images are different from each other in terms of only the color used and the arrangement direction, they will be simply referred to as patch images 56 if it is not necessary to discriminate between them. Each patch image 56 is obtained by superimposing a solid image with black toner as a reference on a solid image with corresponding color toner so as to divide a region with the corresponding color toner into two regions in the conveyance direction of the intermediate transfer belt 12. Note that a crosshatched portion in FIG. 5B indicates a region where the black toner image is superimposed. In the following description, a portion of the patch image 56, in which the black toner image is superimposed, will be referred to as a black region, and the portion of a yellow, magenta, or cyan toner image will be referred to as a color region (first region). Furthermore, among two color regions on two sides of the black region, a region on the leading side of the conveyance direction of the intermediate transfer belt 12 will be referred to as a leading-side color region, and a region on the trailing side will be referred to as a trailing-side color region. Note that in this specification, the downstream side and upstream side of the conveyance direction of the intermediate transfer belt 12 will be referred to as the leading side and trailing side, respectively.

Figure 6:
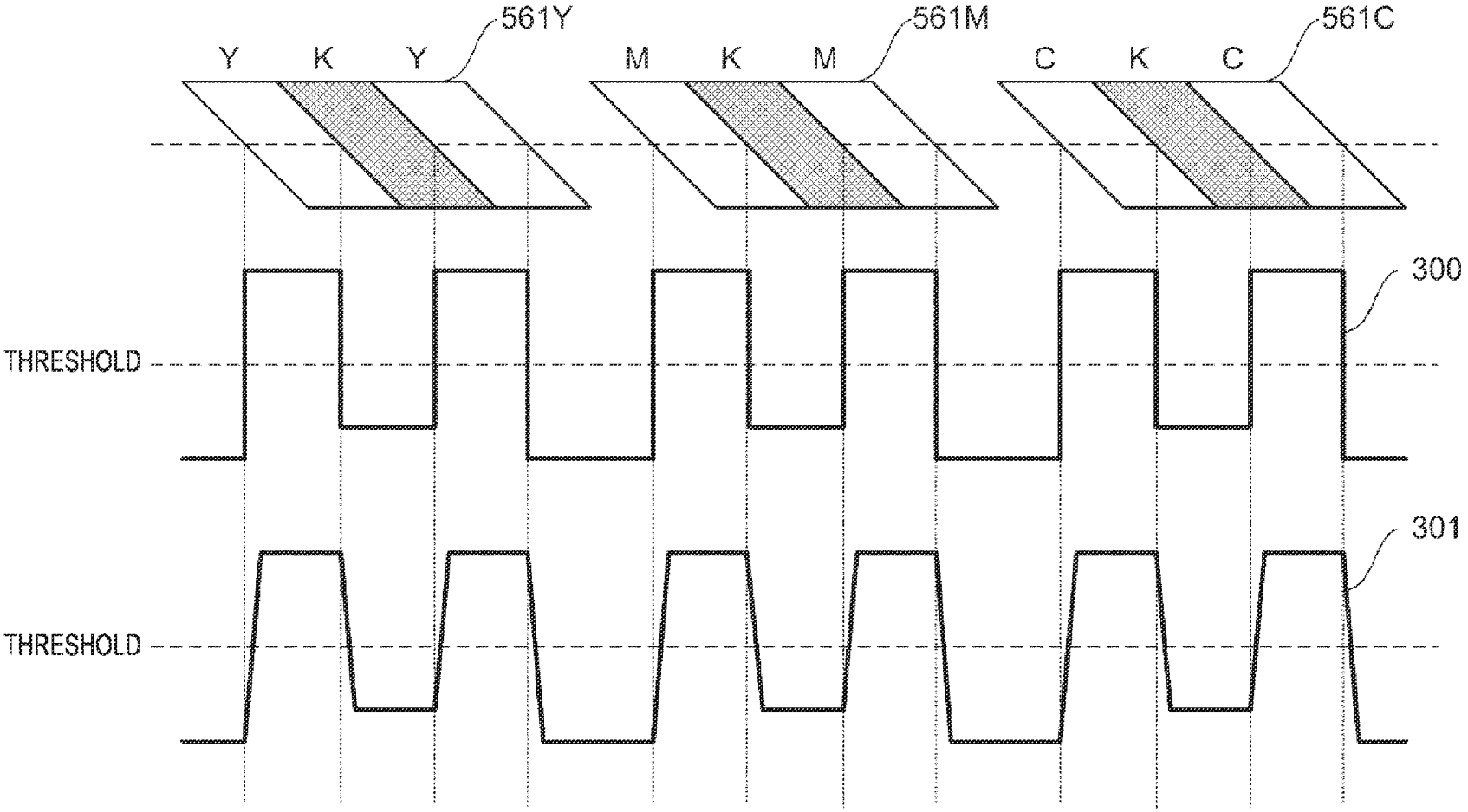
FIG. 6 is a view showing the output waveform of the optical sensor for a position detection patch image.

FIG. 6 shows the output signal waveform of the optical sensor 21 according to movement of the patch images 56. An output signal waveform 300 represents an ideal output waveform, and an output signal waveform 301 represents an actual output waveform.

Light emitted by the light-emitting element 23 is reflected by the intermediate transfer belt 12 at a position where the patch image 56 is not formed on the intermediate transfer belt 12. Specular reflection light from the intermediate transfer belt 12 is strong, and diffuse reflection light from it is weak. Therefore, the amount of the reflected light incident on the light-receiving element 24 at this time is very small. After that, if the position to which light is emitted by the light-emitting element 23 falls within the leading-side color region of the patch image 56 by movement of the intermediate transfer belt 12, the amount of diffuse reflection light becomes large, and the amount of light incident on the light-receiving element 24 also becomes large. When the boundary portion between the leading-side region and the black region of each patch image 56 reaches a position where light emitted by the light-emitting element 23 is reflected, the amount of received light detected by the light-receiving element 24 decreases. This is because the diffuse reflection light from the black toner image decreases. After that, when the boundary portion between the black region and the trailing-side color region is reached, the amount of received light detected by the light-receiving element 24 increases again. When the patch image 56 passes through the position where the light emitted by the light-emitting element 23 is reflected, by movement of the intermediate transfer belt 12, the amount of light incident on the light-receiving element 24 decreases.

The control circuit 101 of the control unit 100 compares the output value of the sensor with a threshold. If the output of the sensor is larger than the threshold, the control circuit 101 outputs high. If the output of the sensor is smaller than the threshold, the control circuit 101 outputs low. When the amount of light received by the light-receiving element 24 exceeds the threshold, (at a timing of changing from low to high), or becomes smaller than the threshold (at a timing of changing from high to low), a position at this time is detected as the boundary of each region. The waveform 300 of FIG. 6 indicates the ideal waveform of the output of the light-receiving element 24, in which the rise time and fall time are substantially zero.

Figure 17A:
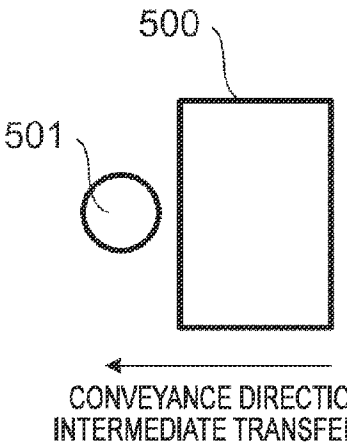
FIGS. 17A to 17D are views showing the relationship between a patch image and the output of an optical sensor.
Figure 17B:
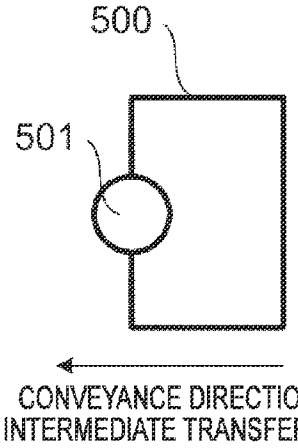
Figure 17C:
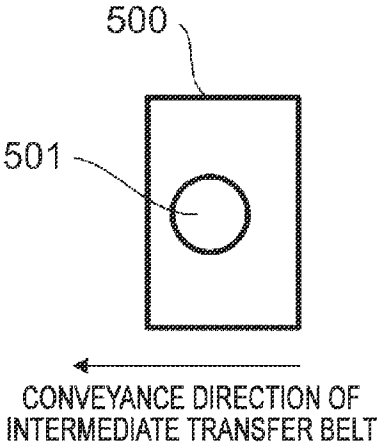
Figure 17D:
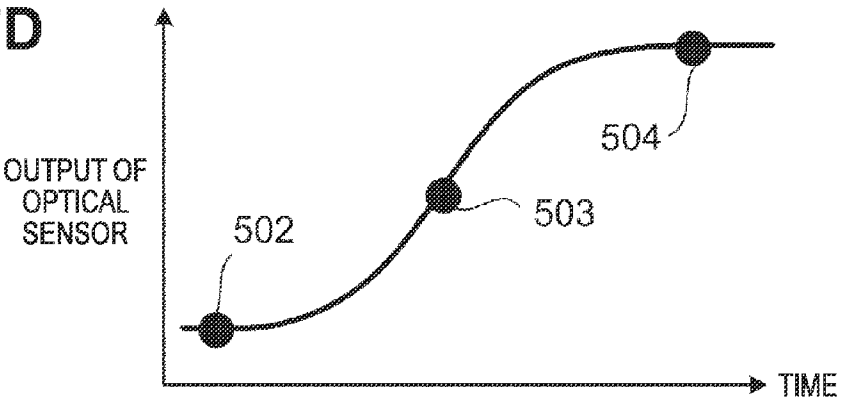

The signal waveform output from the light-receiving element 24 will be described with reference to FIGS. 17A to 17D. FIG. 17A shows a state in which a light spot 501 emitted by the light-emitting element 23 does not enter the patch image 500. FIG. 17B shows a state in which half the light spot 501 emitted by the light-emitting element 23 enters the patch image 500. Furthermore, FIG. 17C shows a state in which the whole light spot 501 emitted by the light-emitting element 23 enters the patch image 500. Note that the patch image 500 is assumed to be uniformly formed within a plane. FIG. 17D shows the output waveform of the light-receiving element 24. Points 502, 503, and 504 indicate the states shown in FIGS. 17A, 17B, and 17C, respectively. In the state shown in FIG. 17A, the patch image 500 has not reached the position of the light spot to obtain only diffuse reflection light from the surface of the intermediate transfer belt 12, and thus the output is not so large. Note that the intermediate transfer belt 12 of the embodiment is black, and adjusts the volume resistance and surface resistance by distributing a conductive material such as carbon black. In the state shown in FIG. 17B, the light spot gradually enters the patch image 500, and thus the amount of the reflected light gradually increases. Since the whole light spot is on the patch image in the state shown in FIG. 17C, the amount of the diffuse reflection light increases and thus a large output is obtained. In this manner, when the patch image 500 passes through the light spot, a change in diffuse reflection output occurs, thereby enabling to detect the edge position of the patch image 500. As described with reference to FIGS. 17A to 17D, the rise time and fall time are not zero for the actual signal output from the optical sensor 21, and a certain rise time and fall time are required. The waveform 301 of FIG. 6 indicates that the actual waveform output from the light-receiving element 24 requires a certain rise time and fall time.

As described above, the rise position and fall position of a signal indicate the boundaries of each region. Furthermore, the duration of high or low of a signal level indicates the width of each region of the patch image 56 in the sub-scanning direction.

As shown in FIG. 6, the black region is detected using the fact that when a black (Bk) pattern is superimposed on a color pattern, the diffuse reflection output of a background (intermediate transfer belt) portion becomes low, that of a color region becomes high, and that of the black region becomes low. It is possible to calculate color misregistration in each of the main scanning direction and the sub-scanning direction depending on how much the relative positional relationship between the color pattern and the black pattern shifts from the original relationship.

If, for example, the width of the leading-side color region of the patch image 561Y is equal to that of the trailing-side color region, it can be determined that there is no misregistration of yellow in the sub-scanning direction with reference to black as a reference color. On the other hand, if the two widths are different from each other, it can be determined that there is misregistration of yellow in the sub-scanning direction with reference to black as a reference color. Note that if the width of the leading-side color region is smaller than that of the trailing-side color region, yellow shifts in a direction opposite to the conveyance direction of the intermediate transfer belt with reference to black. To determine misregistration in the main scanning direction, the two patch images are formed for each color to have line symmetry in the main scanning direction. That is, for example, misregistration in the main scanning direction is determined based on the duration between the position of the patch image 561Y and that of the patch image 562Y. Furthermore, this control operation is performed near two end portions of the thrust direction to detect a tilt with respect to the thrust direction, or the like.

As indicated by the output waveform 301, the rise time and fall time are not zero for the actual signal output from the optical sensor 21, and a certain rise time and fall time are required.

In the present embodiment, misregistration indicates relative misregistration of a color with respect to a reference color. If the fall speed and rise speed are equal to each other in each patch image 56, an error in detected position is cancelled not to have an influence on a color registration adjustment control operation. Since each patch image 56 is formed on the same intermediate transfer belt 12, and is detected by the same optical sensor 21, similar influences given by the conveyance speed, the optical characteristics of the optical sensor 21, and the like are exerted on the patch images 56 for each color. If, therefore, the density of each region of each patch image 56 is constant, the fall speed and rise speed are equal to each other in the patch image 56. In this embodiment, a density control operation is executed before a color registration adjustment control operation.

Figure 7:
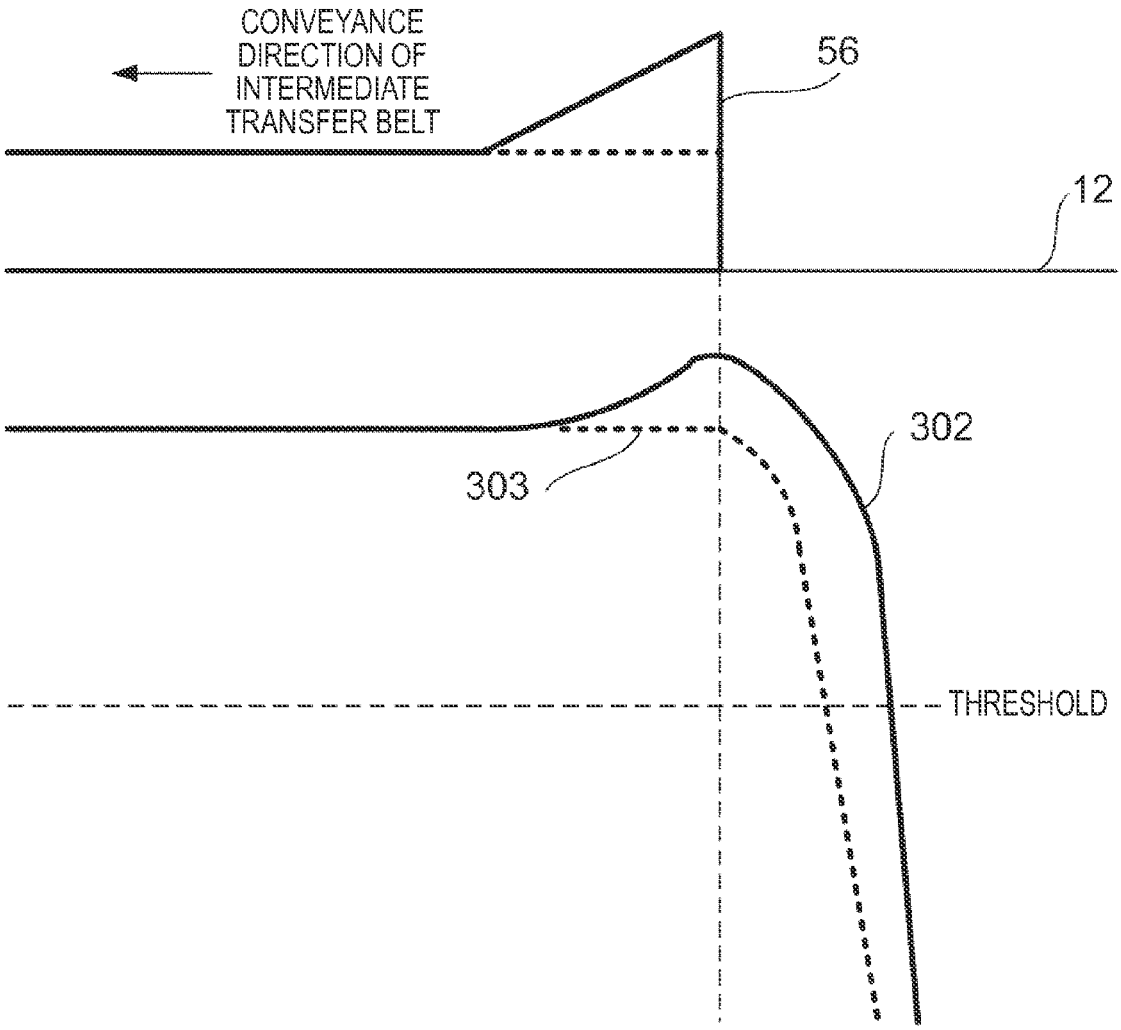
FIG. 7 is a view for explaining the occurrence of a detection error due to the edge density variation phenomenon.

Even if, however, a density control operation is executed, an error occurs in a detected position when the edge density variation phenomenon in which the density is high in the edge of the patch image occurs. FIG. 7 shows the output signal of the optical sensor 21 when the edge density variation phenomenon occurs. As indicated by a waveform 303, if no edge density variation phenomenon occurs, the output of the optical sensor 21 starts to decrease at the trailing edge of the patch image 56. When, however, the edge density variation phenomenon occurs, the amount of applied toner increases at the edge of the patch image, as shown in FIG. 7. As the density of toner increases, therefore, the output of the optical sensor 21 accordingly increases temporarily, and then decreases, as indicated by a waveform 302. Thus, the timing when the output becomes smaller than the threshold shifts, and an error occurs in a detected edge position.

If the rotation direction of the photosensitive member 3 is the same as that of the developing sleeve 41 like this embodiment, the edge density variation phenomenon mainly occurs at the edge of the electrostatic latent image formed on the photosensitive member 3 upstream of the rotation direction of the photosensitive member 3, as will be described below. That is, the phenomenon occurs at the trailing edge of the patch image.

Figure 8:
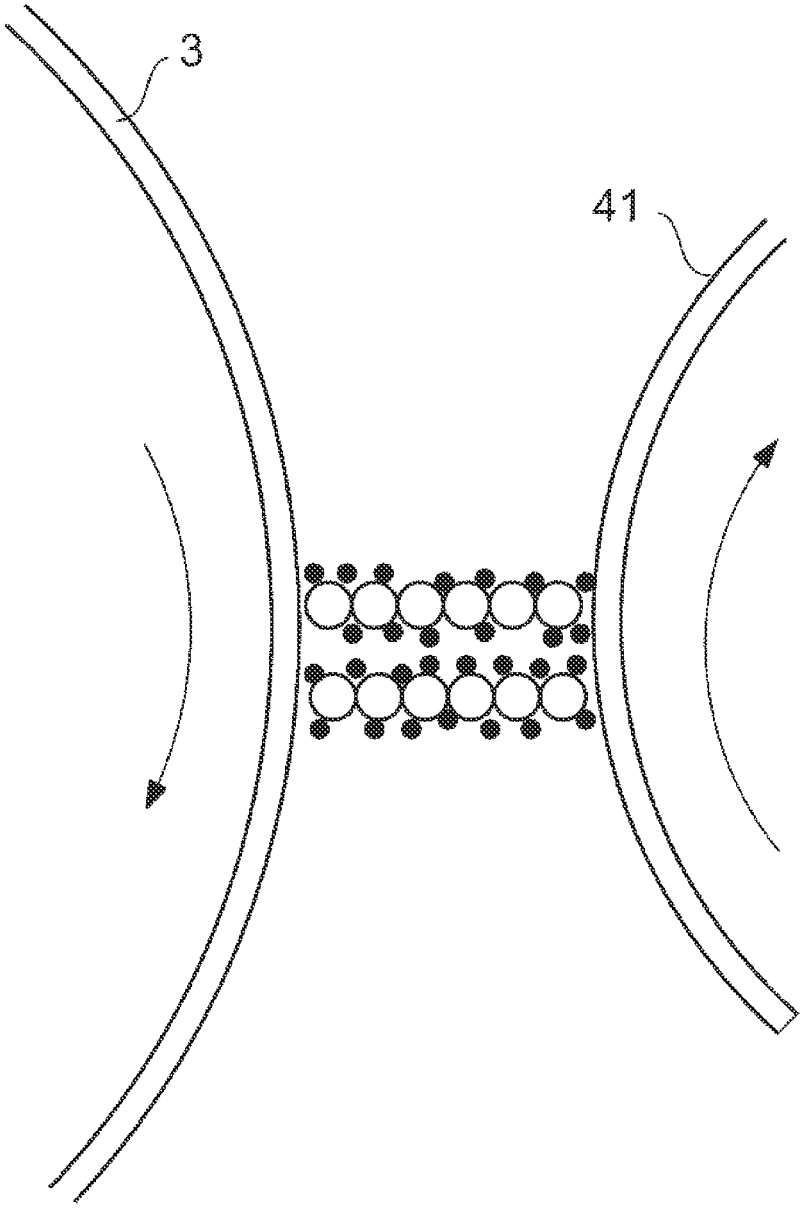
FIG. 8 is a view showing details of a development region.

The reason why the edge density variation phenomenon occurs in a reversal development method will be described with reference to FIGS. 8 and 9A to 9C. Note that the downstream side and upstream side of the rotation direction of the photosensitive member 3 will be referred to as the leading side and trailing side, respectively, in the following description. As shown in FIG. 8, in the development region where the photosensitive member 3 faces the developing sleeve 41, the developing sleeve 41 supplies nonmagnetic toner to the electrostatic latent image formed on the photosensitive member 3, thereby performing development. Note that referring to FIG. 8, an open circle represents magnetic carrier and a closed circle represents nonmagnetic toner.

Figure 9A:
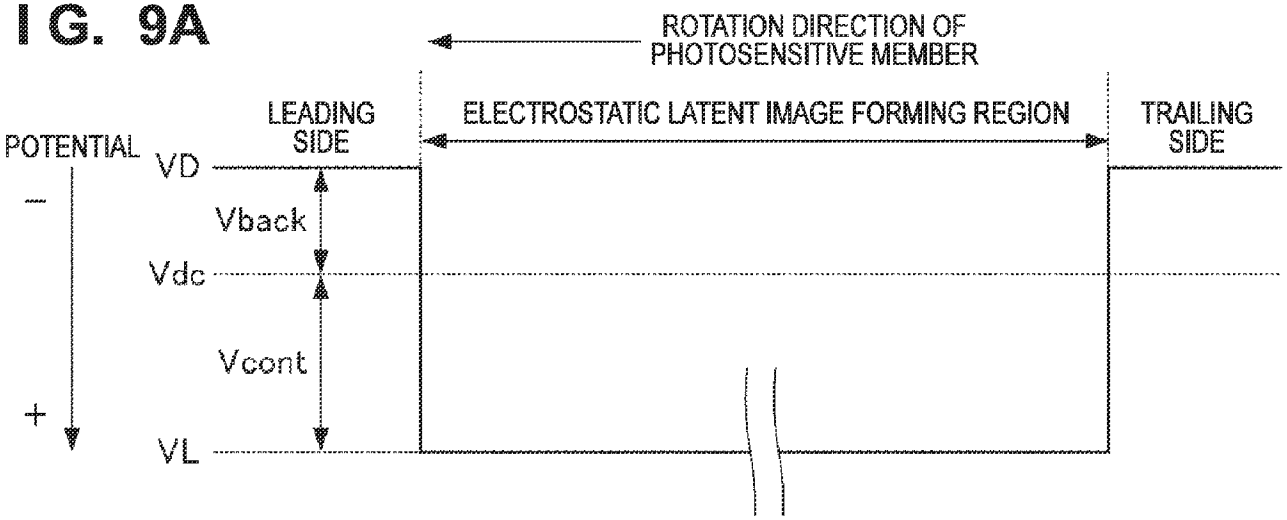
FIGS. 9A to 9C are views for explaining the occurrence of the edge density variation phenomenon according to an embodiment.
Figure 9B:
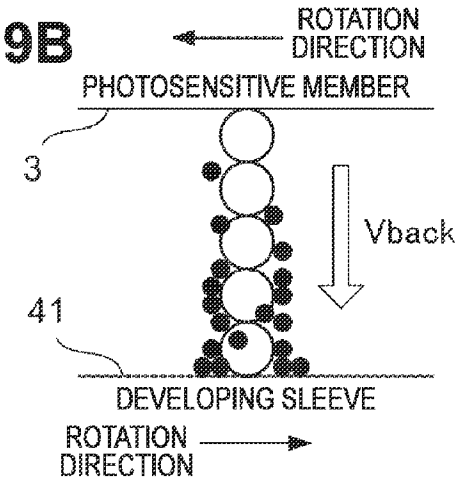
Figure 9C:
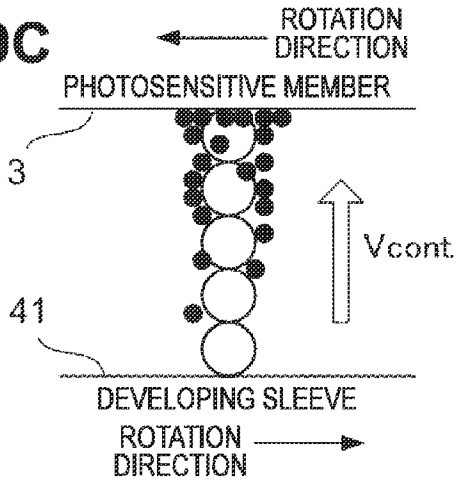

FIG. 9A shows an electrostatic latent image forming region (a region where an electrostatic latent image corresponding to the patch image 56 has been formed on the photosensitive member 3), and its potential states on the leading side and trailing side. Referring to FIG. 9A, reference symbol VD denotes a potential in a region which is not exposed, that is, a dark-portion potential; VL, a potential in a region (a region where the electrostatic latent image corresponding to the patch image 56 has been formed) which is exposed; that is, a bright-portion potential; and Vdc, the potential of the developing sleeve 41. If the electrostatic latent image on the photosensitive member 3 has not entered the development region, and the potential of the photosensitive member 3 is VD on the leading side of the electrostatic latent image forming region, negatively charged nonmagnetic toner moves to the developing sleeve 41 side by a back contrast potential Vback, as shown in FIG. 9B. In the development region, therefore, the amount of toner near the photosensitive member 3 is small, and that near the developing sleeve 41 is large. After that, when the electrostatic latent image enters the development region, and the potential of the photosensitive member 3 becomes VL, the negatively charged nonmagnetic toner moves to the photosensitive member 3 side by a contrast potential Vcont. In the development region, therefore, the amount of toner near the photosensitive member 3 is large, and that near the developing sleeve 41 is small. When the trailing edge of the electrostatic latent image reaches the development region, the toner is forced back to the developing sleeve 41 side by the back contrast potential. However, a lot of toner exists near the photosensitive member 3, and cannot go back to the developing sleeve 41 side, and some toner is developed at the trailing edge of the electrostatic latent image. Therefore, the amount of applied toner becomes large near the trailing edge of the electrostatic latent image, thereby causing the edge density variation phenomenon on the trailing side.

This phenomenon tends to occur when the developability of toner; that is, the mobility of toner drops due to degradation of the developer, a change in toner density, or the like, and it is thus impossible to cancel the contrast potential with the toner. That is, if the potential of toner developed on the photosensitive member 3 is equal to that of the developing sleeve 41, an electric field that moves negatively charged toner to the photosensitive member 3 is not applied. If, however, the developability drops, and the potential of toner developed on the photosensitive member 3 is not equal to that of the developing sleeve 41, toner at the trailing edge of the electrostatic latent image tends to move, thereby causing the edge density variation phenomenon. Since the developability changes by executing an image forming operation, the level of the edge density variation phenomenon also changes, and thus it is difficult to stabilize a color registration adjustment control operation.

Figure 10:
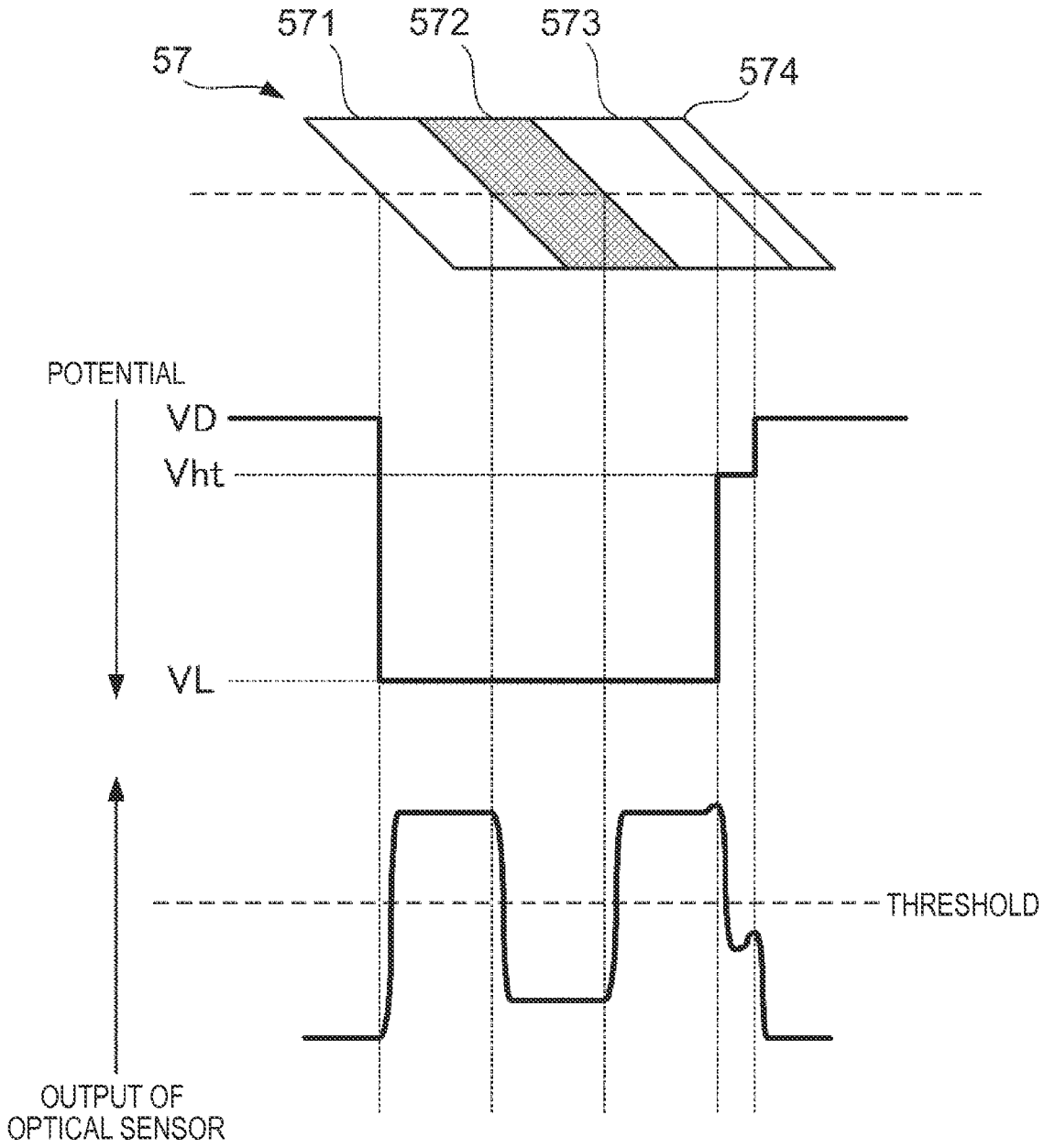
FIG. 10 is a view showing a position detection patch image according to an embodiment.

In the embodiment, therefore, a patch image 57 shown in FIG. 10 is used instead of the conventional color misregistration detection patch image 56. The patch image 57 is used to detect relative misregistration of each color with respect to a reference color, similarly to the patch image 56. A leading-side color region 571 or trailing-side color region 573 is a solid image with cyan, magenta, or yellow toner according to a color to be detected. Note that similarly to the patch image 56, the leading-side color region 571 and trailing-side color region 573 have the same color. A black region 572 is a solid image with black toner. The patch image 57 of this embodiment includes a halftone region 574 (a second region) which has the same color as that of the leading-side color region 571 and trailing-side color region 573, and is adjacent to the trailing edge of the trailing-side color region 573.

For the patch image 56, the dark-portion potential VD enters the development region while a lot of toner exists near the photosensitive member 3. For the patch image 57, however, a potential Vht corresponding to the halftone region 574 enters the development region first. In this case, since the toner is developed in the halftone region 574, the edge density variation phenomenon in the trailing-side color region 573 is reduced, thereby decreasing a position detection error. Note that the density of the halftone region 574 is set to be equal to or smaller than the edge detection threshold, as shown in FIG. 10. That is, the density of each region is determined so that the amount of light in the halftone region 574 detected by the optical sensor 21 is on the opposite side of the amount of light in the trailing-side color region 573 with respect to the threshold (so the amount of light from region 574 detected by optical sensor 21 is on the opposite side of the threshold to the amount of light from region 573 detected by the optical sensor 21). The halftone region 574 does not have an influence on position detection. Note that although the edge density variation phenomenon occurs on the trailing side of the halftone region 574, the contrast potential of the halftone region 574 is small, and its level is low.

As described above, the signal level of the halftone region 574 detected by the optical sensor 21 is set to be smaller than the edge detection threshold. Assume, for example, that the edge detection threshold is set to 1.2 V. In this case, the patch image 57 is formed so that the signal levels of the leading-side color region 571 and trailing-side color region 573 are at 1.7 V, and that of the halftone region 574 is at 0.8 V. Although the density variation phenomenon occurs at the trailing edge of the trailing-side color region 573 and that of the halftone region 574 as shown in FIG. 10, the degree of the phenomenon is small, thereby decreasing a detection error due to fluctuation of the output waveform of the optical sensor 21.

Figure 11:
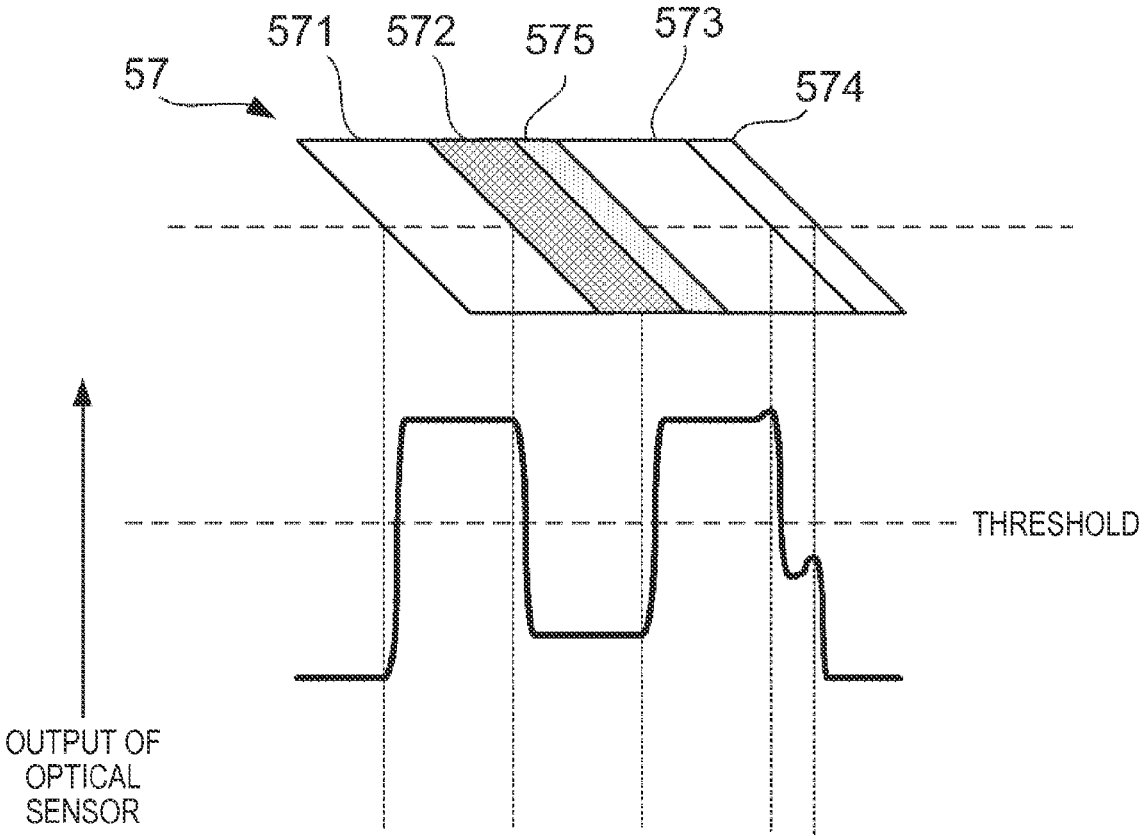
FIG. 11 is a view showing a position detection patch image according to an embodiment.

It is possible to decrease a detection error due to the edge density variation phenomenon by forming the halftone region 574 with a corresponding color at the trailing edge of each position detection patch image 57. Note that as the developability of black toner changes, the edge density variation phenomenon occurs. It is, therefore, possible to further decrease the detection error by forming a black halftone region 575 between the black region 572 and the trailing-side color region 573, as shown in FIG. 11.

Figure 12:
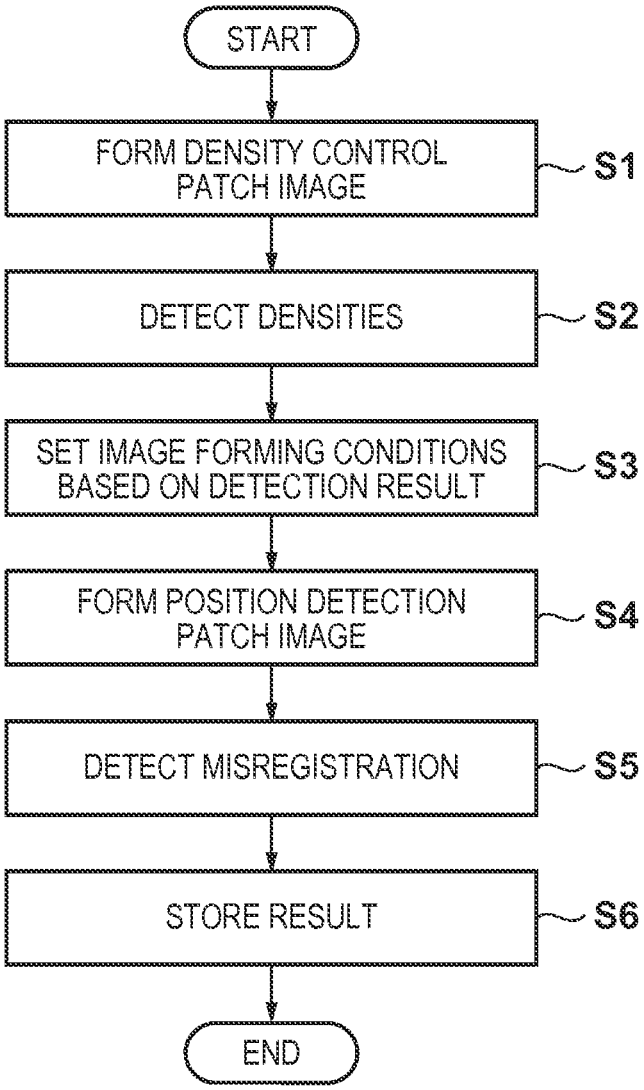
FIG. 12 is a flowchart illustrating density control and color registration control processing according to an embodiment.

Lastly, density and registration control processing executed by the control unit 100 will be described with reference to FIG. 12. Note that the control unit 100 executes the density and registration control processing at a predetermined timing, for example, upon power-on. In step S1, the control unit 100 controls the image forming unit 1 to form, on the intermediate transfer belt 12, the density control patch images 51 to 55, which have been described with reference to FIG. 5A. In step S2, the control unit 100 detects the densities of the patch images 51 to 55 based on the amount of light received by the optical sensor 21. In step S3, the control unit 100 sets, for example, exposure conditions and image forming conditions such as a contrast potential so that a difference between the detected density and a density to be formed becomes smaller. In step S4, the control unit 100 controls the image forming unit 1 to form, on the intermediate transfer belt 12, the position detection patch image 57, which has been described with reference to FIG. 10 or 11. In step S5, the control unit 100 detects misregistration of each toner image with respect to the reference color in the main scanning direction and the sub-scanning direction. In step S6, the control unit 100 sets the image forming conditions to correct the misregistration while storing the amount of the detected misregistration in the RAM 107. More specifically, the control unit 100 controls a timing of exposure by the exposure device 5 of each photosensitive member 3, or the like.

Second Embodiment

Figure 13:
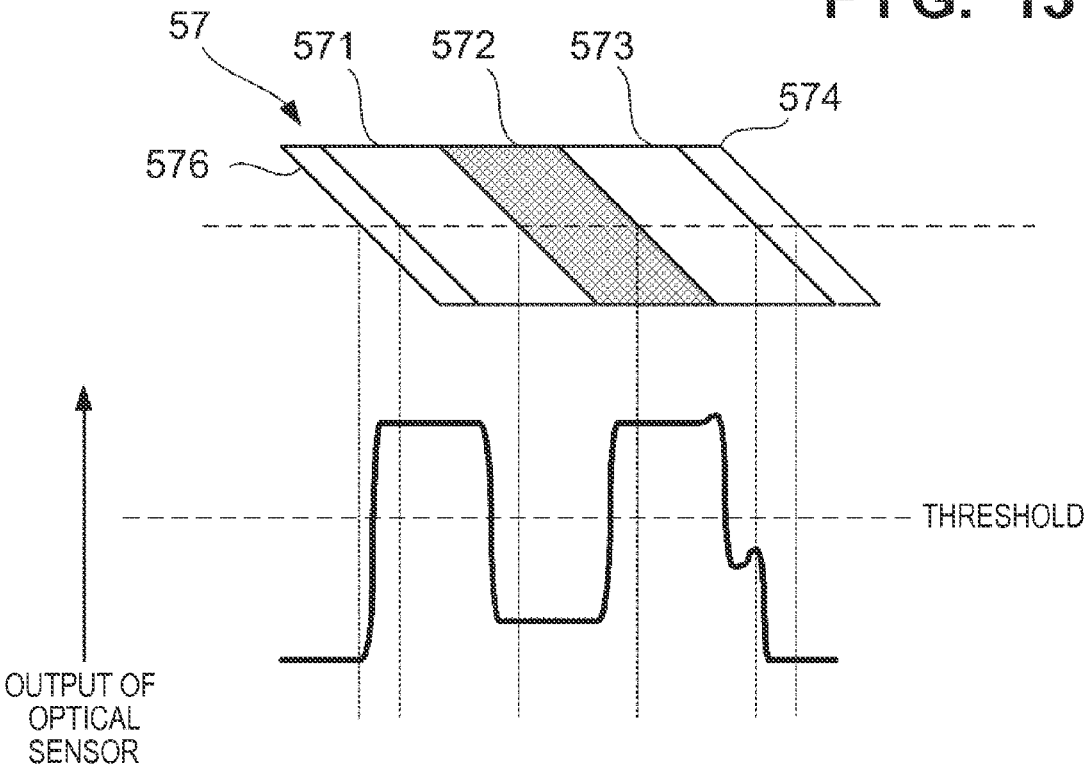
FIG. 13 is a view showing a position detection patch image according to an embodiment.

In the second embodiment, different points from the first embodiment will be mainly described. Note that in this embodiment, the arrangement of an image forming unit 1 and control unit 100 is the same as that in the first embodiment, and a description thereof will be omitted. FIG. 13 is a view showing a position detection patch image 57 and a signal waveform output from an optical sensor 21 according to the present embodiment. In the present embodiment, a halftone region 576 with a corresponding color is formed at the leading edge of a leading-side color region 571 in addition to a halftone region 574. Note that the density level of the halftone region 576 is the same as that in the first embodiment. Furthermore, the halftone region 574 has the same purpose as that in the first embodiment. In the embodiment, to make the sensor output have line symmetry with respect to a black region 572 at the center, the halftone region 576 is formed. With this arrangement, the rise speed becomes equal to the fall speed, thereby improving the accuracy of position detection.

Figure 14:
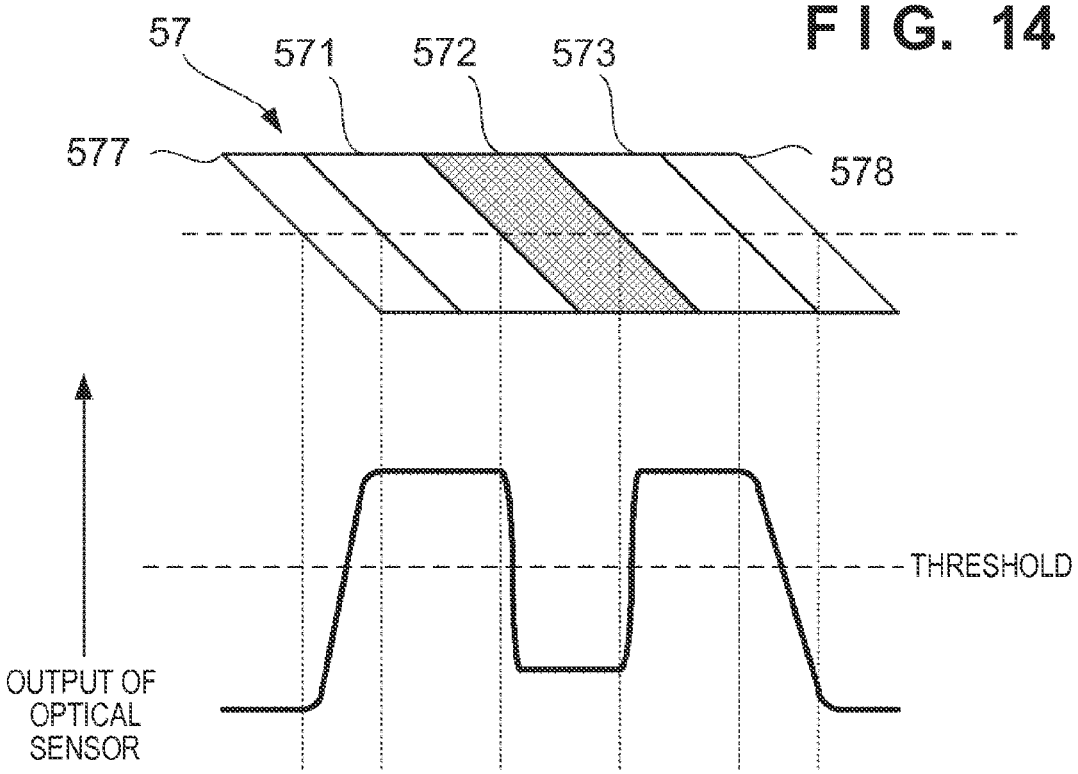
FIG. 14 is a view showing a position detection patch image according to an embodiment.

As shown in FIG. 14, instead of the halftone regions, a first gradation region 577 may be arranged before the leading-side color region 571, and a second gradation region 578 may be arranged after the trailing-side color region 573. The first gradation region 577, the leading-side color region 571, the second gradation region 578 and the trailing-side color region 573 have the same color. The density of the gradation region 577 gradually increases to that of the leading-side color region 571, and the density of the gradation region 578 gradually decreases from that of the trailing-side color region 573. The potential of a photosensitive member 3 gradually changes in the gradation regions 577 and 578, thereby making the edge density variation phenomenon difficult to occur. It is, therefore, possible to decrease the amount of an error in detected position.

Third Embodiment

In the third embodiment, different points from the first embodiment will be mainly described. In the first embodiment, the rotation direction of the photosensitive member 3 is the same as that of the developing sleeve 41. In this embodiment, a photosensitive member 3 and developing sleeve 41 rotate in mutually opposite directions. Note that the rotation direction of the developing sleeve 41 in this embodiment is opposite to that in the first embodiment. In a development region, therefore, the position of a regulation blade 42 arranged upstream of the rotation direction of the developing sleeve 41 is different from that in FIG. 1. The arrangement is otherwise the same as that in the first embodiment. Note that the rotation directions of the photosensitive member 3 and developing sleeve 41 are opposite to each other, the tangential velocity of the developing sleeve 41 is generally set to be higher than that of the photosensitive member 3 to supply a large amount of a developer to the development region. For example, the velocity of the photosensitive member 3 is set to 135 mm/s, while the velocity of the developing sleeve 41 is set to 230 mm/s which is 1.7 times higher than that of the photosensitive member 3.

Figure 15:
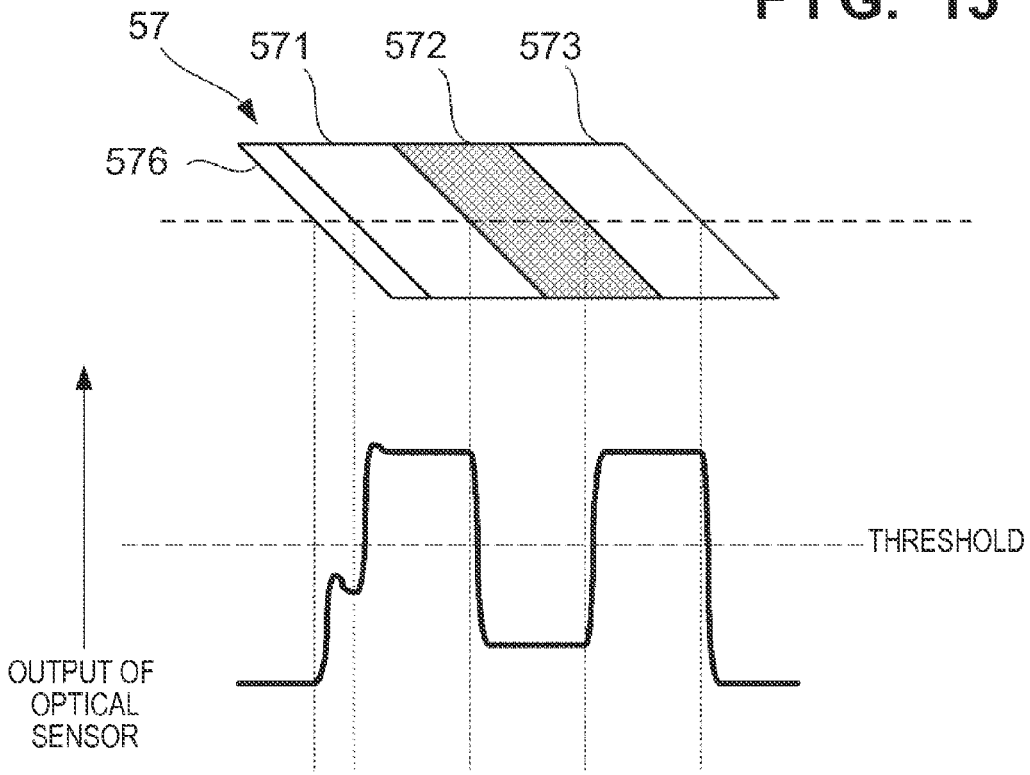
FIG. 15 is a view showing a position detection patch image according to an embodiment.
Figure 16:
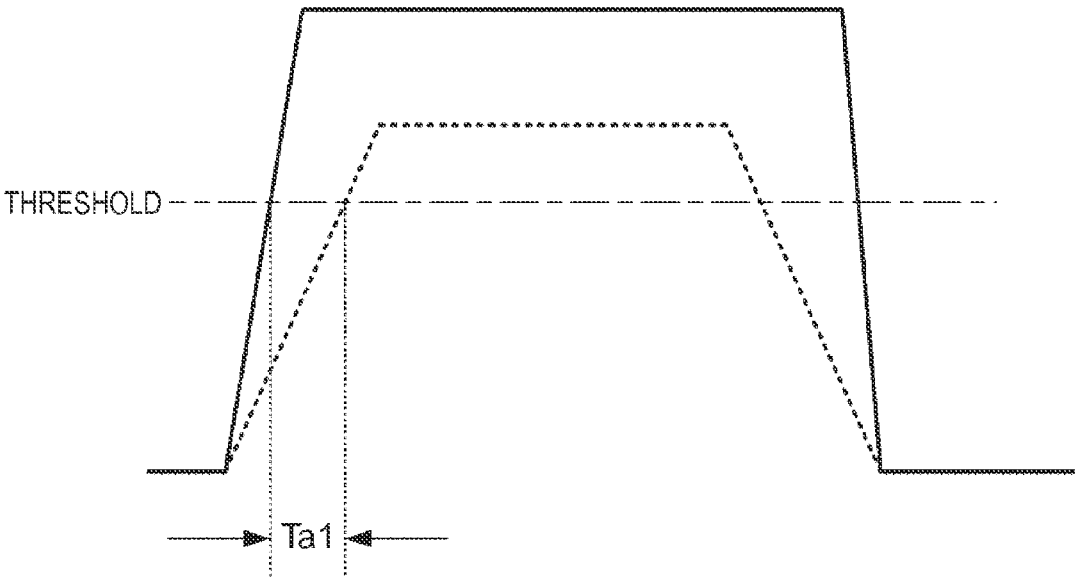
FIG. 16 is a view for explaining a change in detected position depending on the density of a patch image.

In this embodiment, the moving direction of the developing sleeve 41 with respect to the photosensitive member 3 is opposite to that in the first embodiment, and a patch image on the photosensitive member 3 is developed from the trailing side. That is, in this embodiment, the edge density variation phenomenon tends to occur at the leading edge position of an electrostatic latent image on the photosensitive member 3. To deal with this problem, in the embodiment, a halftone region 576 with the same color as that of a leading-side color region 571 is arranged before the leading-side color region 571, as shown in FIG. 15. Conditions such as the density of the halftone region 576 are the same as those in the first embodiment. In this embodiment, it is possible to decrease a shift of the timing, when the output signal of an optical sensor 21 crosses an edge detection threshold, due to the edge density variation phenomenon, thereby performing a stable color registration adjustment control operation, similarly to the first embodiment. Note that in this embodiment, it is also possible to arrange a halftone region 574 on the trailing side of a trailing-side color region, similarly to the second embodiment.

By arranging a halftone region at either edge or both the edges of a patch image in the moving direction of an intermediate transfer belt 12, it becomes possible to decrease an error in detected position of the patch image due to the edge density variation phenomenon, and therefore execute a stable color registration adjustment control operation. Note that in the above-described embodiments, a black toner image as a reference is superimposed on a patch image for detecting misregistration of each color. The present invention, however, is also applicable to a case in which a separate patch image is formed, instead of superimposing a toner image as a reference on a toner image of a color to undergo a misregistration detection operation. Although the position of the patch image on the intermediate transfer belt 12 is detected using the optical sensor 21, the optical sensor 21 may detect the patch image formed on a photosensitive member or printing material as an image carrier.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-286621, filed on Dec. 27, 2011, which is hereby incorporated by reference herein in its entirety.

What is claimed is:

1. An image forming apparatus comprising:

a plurality of photosensitive members;

a plurality of exposure units configured to expose the plurality of photosensitive members;

a plurality of developing units configured to develop, using developer, latent images formed on the plurality of photosensitive members by the exposure units;

an image carrier, onto which the developed images formed on the photosensitive members are transferred;

a sensor configured to irradiate the image carrier with light, and detect an amount of reflected light;

a patch detection unit configured to detect a position of a patch image, transferred onto the image carrier, based on the amount of reflected light detected by the sensor; and a registration adjustment unit configured to calculate an amount of misregistration based on the position of the patch image detected by the patch detection unit, and execute registration adjustment based on the amount of misregistration, wherein the patch image has a first region and a second region immediately adjacent to each other, and a density of the second region is lower than that of the first region, the first region and the second region of the patch image are formed on the same photosensitive member, a rotation direction of which is the same as that of a developing sleeve of a corresponding developing unit of the developing units, the second region of the patch image is formed at a trailing side of the patch image in a conveyance direction of the image carrier and is not formed at a leading side of the patch image in the conveyance direction of the image carrier, the patch detection unit is further configured to detect the position of the patch image based on a comparison result between the amount of reflected light and a predetermined threshold, an amount of reflected light from the second region is lower than the predetermined threshold, and an amount of reflected light from the first region is higher than the predetermined threshold.

2. An image forming apparatus comprising:

a plurality of photosensitive members;

a plurality of exposure units configured to expose the plurality of photosensitive members;

a plurality of developing units configured to develop, using developer, latent images formed on the plurality of photosensitive members by the exposure units;

an image carrier, onto which the developed images formed on the photosensitive members are transferred;

a sensor configured to irradiate the image carrier with light, and detect an amount of reflected light;

a patch detection unit configured to detect a position of a patch image, transferred onto the image carrier, based on the amount of reflected light detected by the sensor; and a registration adjustment unit configured to calculate an amount of misregistration based on the position of the patch image detected by the patch detection unit, and execute registration adjustment based on the amount of misregistration, wherein the patch image has a first region and a second region immediately adjacent to each other, and a density of the second region is lower than that of the first region, the first region and the second region of the patch image are formed on the same photosensitive member, a rotation direction of which is opposite to a rotation direction of a developing sleeve of a corresponding developing unit of the developing units, and a tangential velocity of which is lower than that of the developing sleeve, the second region of the patch image is formed at a leading side of the patch image in a conveyance direction of the image carrier and is not formed at a trailing side of the patch image in the conveyance direction of the image carrier, the patch detection unit is further configured to detect the position of the patch image based on a comparison result between the amount of reflected light and a predetermined threshold, an amount of reflected light from the second region is lower than the predetermined threshold, and an amount of reflected light from the first region is higher than the predetermined threshold.

3. The apparatus according to claim 1, wherein the developer is a two-component developer including nonmagnetic toner and magnetic carrier.

4. The apparatus according to claim 1, further comprising another photosensitive member, wherein a color type of an image formed on the other photosensitive member is black and different from color types of images formed on the plurality of photosensitive members, and a patch image formed on the other photosensitive member is superimposed on a patch image formed on a photosensitive member of the plurality of photosensitive members.

5. The apparatus according to claim 4, wherein the patch image formed on the other photosensitive member has two regions adjacent to each other in the conveyance direction of the image carrier, and a density of the region on the trailing side of the patch image formed on the other photosensitive member is lower than that of the region on the leading side.

6. The apparatus according to claim 4, wherein the color types of the images formed on the plurality of photosensitive members are yellow, cyan and magenta.

7. The apparatus according to claim 1, wherein the first region includes the leading side of the patch image.

8. The apparatus according to claim 2, wherein the developer is a two-component developer including nonmagnetic toner and magnetic carrier.

9. The apparatus according to claim 2, further comprising another photosensitive member, wherein a color type of an image formed on the other photosensitive member is black and different from color types of images formed on the plurality of photosensitive members, and a patch image formed on the other photosensitive member is superimposed on a patch image formed on a photosensitive member of the plurality of photosensitive members.

10. The apparatus according to claim 9, wherein the patch image formed on the other photosensitive member has two regions adjacent to each other in the conveyance direction of the image carrier, and a density of the region on the trailing side of the patch image formed on the other photosensitive member is lower than that of the region on the leading side.

11. The apparatus according to claim 2, wherein the first region includes the trailing side of the patch image.

12. The apparatus according to claim 9, wherein the color types of the images formed on the plurality of photosensitive members are yellow, cyan and magenta.

* * * * *